US007412846B2

(12) United States Patent
Sekiya et al.

(10) Patent No.: US 7,412,846 B2
(45) Date of Patent: Aug. 19, 2008

(54) ISOTHERMAL TRANSPORTATION CONTAINER

(75) Inventors: Sachio Sekiya, Hitachinaka (JP); Tatsuo Fujii, Mito (JP); Hirotsugu Kuroume, Hitachi (JP); Toshiaki Inuma, Tokyo (JP); Yusuke Kiritoshi, Mitaka (JP); Hiroaki Matsushima, Ryugasaki (JP)

(73) Assignee: Hitachi, Ltd., Tokyo (JP)

( * ) Notice: Subject to any disclaimer, the term of this patent is extended or adjusted under 35 U.S.C. 154(b) by 378 days.

(21) Appl. No.: 11/349,921

(22) Filed: Feb. 9, 2006

(65) Prior Publication Data

US 2006/0191282 A1 Aug. 31, 2006

(30) Foreign Application Priority Data

Feb. 25, 2005 (JP) ..... 2005-049920

(51) Int. Cl.
*F25D 3/08* (2006.01)

(52) U.S. Cl. ..... 62/371; 62/457.2

(58) Field of Classification Search ..... 62/371, 62/457.1, 457.2

See application file for complete search history.

(56) References Cited

U.S. PATENT DOCUMENTS

| | | | | |
|---|---|---|---|---|
| 4,037,650 | A * | 7/1977 | Randall | 165/10 |
| 6,089,038 | A * | 7/2000 | Tattam | 62/457.2 |
| 6,247,328 | B1 * | 6/2001 | Mogil | 62/457.2 |
| 6,308,518 | B1 * | 10/2001 | Hunter | 62/3.3 |
| 6,415,615 | B1 * | 7/2002 | Osborne et al. | 62/130 |
| 6,725,670 | B2 * | 4/2004 | Smith et al. | 62/6 |
| 6,968,711 | B2 * | 11/2005 | Smith et al. | 62/371 |

FOREIGN PATENT DOCUMENTS

JP 2004-217290 8/2004

* cited by examiner

*Primary Examiner*—Melvin Jones
(74) *Attorney, Agent, or Firm*—Antonelli, Terry, Stout & Kraus, LLP.

(57) ABSTRACT

An isothermal transportation container comprises an insulating container and a lid that can seal this insulating container. The insulating container has a plurality of insulating materials arranged overlapped on the inner peripheral face of the insulating container. A thermal conductive member is arranged in a space of the insulating container formed by the insulating materials. The thermal conductive member can accommodate a plurality of laminated packaging containers, each of which accommodates a thermal storage medium and a transported article. The heat in the thermal storage medium in one packaging container can be transmitted to the other packaging container through the thermal conductive member.

16 Claims, 5 Drawing Sheets

ISOTHERMAL TRANSPORTATION CONTAINER

CLAIM OF PRIORITY

The present application claims priority from Japanese patent application serial JP 2005-044920 filed on Feb. 25, 2005, the content of which is hereby incorporated by reference into this application.

FIELD OF THE INVENTION

The present invention relates to an isothermal transportation container and a packaging container accommodated therein, and more particularly to an isothermal transportation container and a packaging container for maintaining the temperature of an article transported to a predetermined temperature.

BACKGROUND OF THE INVENTION

The Patent Reference 1 discloses an example of an isothermal transportation container for transporting a substance such as cell tissue to keep it warm. The transportation container disclosed in this application has a double structure of an inner container and outer container for transporting a medical tool for cell tissue around a room temperature. The inner container is provided with a function for cushioning heat accumulation and heat transfer, and the outer container is provided with an insulating function. This structure allows the transportation at around room temperatures.

[Patent Reference 1]

Japanese Patent Laid-Open No. 2004-217290

The above-mentioned conventional transportation container for a medical tool can simply and easily maintain the temperature of a subject to be transported to a predetermined temperature range. However, the heat transfer in the transportation container is restrained, so that there is a fear of the temperature distribution in the transportation container being extremely non-uniform. For example, if the heat dissipation amount from the bottom face of the transportation container is excessively great, the temperature at the bottom side lowers, resulting in that the temperature of the thermal storage medium at the bottom side lowers at an early stage. In this case, even if a thermal storage medium having sufficient heat storage amount is provided on the side of the upper face considering the heat dissipation from the bottom side, it is difficult to transmit the heat storage amount to the heat dissipating section due to the insulating function, so that the amount of heat cannot effectively be utilized. The temperature of the subject to be transported lowers from the bottom side.

When plural transported articles are transported, the heat transfer among the respective transported article is difficult, with the result that the temperature of each transported article varies. As a result, the subject to be transported that cannot be kept within a desired temperature range might be generated. In the case where an open-air temperature is low, or in the case where the time taken for the transportation is long, the amount of heat dissipation increases. Therefore, the heat storage amount should be increased for implementing the heat dissipation. However, the added thermal storage medium might not effectively be utilized due to the insulating function.

SUMMARY OF THE INVENTION

The present invention is accomplished in view of the problems of the conventional technique, and an object of the invention is to keep a predetermined temperature range over a long period in an isothermal transportation container having a simple and easy structure. Another object of the invention is that a transported article can be transported with a constant temperature over a long period. The present invention aims to accomplish at least one of these objects.

In order to accomplish the aforesaid objects, an isothermal transportation container comprises an insulating container and a lid that can seal the insulating container, wherein the insulating container has plural insulating materials arranged overlapped on the inner peripheral face thereof, wherein a thermal conductive member is arranged in a space in the insulating container formed by the insulating materials, wherein the thermal conductive member can accommodate plural laminated packaging containers, each of which accommodates a thermal storage medium and a transported article, and is arranged so as to be thermally in contact with the packaging containers, wherein the heat in the thermal storage medium in one packaging container can be transmitted to the other container through the thermal conductive member.

In this isothermal transportation container, the upper end section of the thermal conductive member may be bent by which a user can take out the packaging container. The outer surface of the transported article may be covered with a second thermal conductive member. The inner shape of the insulating container may be cylindrical, and the insulating material may be a mat-like vacuum insulating material, wherein plural vacuum insulating materials may be laminated along the cylindrical surface. The end sections of the vacuum insulating material may be changed in the laminate direction. The end face at the lower side of the vacuum insulating material may be set lower than the inner bottom face of the insulating container. A temperature sensor may be provided on the back surface of the lid and a display section for displaying the temperature detected by the temperature sensor may be provided on the surface of the lid. The temperature sensor may be in contact with the thermal conductive member.

In order to accomplish the aforesaid objects, an isothermal transportation container has an insulating container and a lid that can seal the insulating container, wherein the insulating container has plural insulating materials arranged overlapped on the inner peripheral face thereof, and a thermal conductive member is arranged in the space of the insulating container formed by the insulating materials, wherein the thermal conductive member can accommodate a container, that has an insulating material for accommodating a transported article therein, and thermal storage medium as alternately laminated, and is arranged so as to be thermally in contact with the container and the thermal storage medium, wherein the heat in the thermal storage medium can be transmitted to the container through the thermal conductive member.

In order to accomplish the aforesaid objects, an isothermal transportation container has an insulating container and a lid that can seal the insulating container, wherein the insulating container has plural insulating materials arranged overlapped on the inner peripheral face thereof, and a thermal conductive member is arranged in the space of the insulating container formed by the insulating materials, wherein the thermal storage medium is arranged on the side of the inner face of the thermal conductive member and this storage medium can accommodate a subject to be transported that has plural packaging containers each accommodating a transported article therein and that is covered with a second thermal conductive member.

In order to accomplish the aforesaid objects, a packaging container used for an isothermal transportation container has an insulating container, a lid for sealing the insulating container, and a thermal storage medium accommodated therein. Further, it has a lid section that can be opened and closed, a box section that forms a sealing container with the lid section, flexible films accommodating the thermal storage medium in the space formed by the lid section and the box section and formed on the mating face between the lid section and the box section for closing the respective spaces, wherein a space in which a transported article can be stored is formed at the center of each film, and plural ribs are formed in the space formed by the lid section and the box section.

The outer surface of this packaging container may be covered with a thermal conductive member. The ribs may be provided so as to project inwardly from the outer wall face of the thermal storage medium accommodating section. The height of each rib formed on the lid section may be set higher than the height of each rib formed on the box section. The thermal storage medium may be sealed in a container that is made at least partially of a transparent material.

In order to accomplish the aforesaid objects, a carrier container for the isothermal transportation container is an insulating container that can accommodate plural isothermal transportation containers, and is provided with a temperature display means for displaying a temperature detected by a temperature sensor at each isothermal transportation container. It may have means for giving an alarm when the temperature in the isothermal transportation container deviates from the predetermined range.

According to the present invention, the thermal conductive member is suitably arranged in the isothermal transportation container, whereby the temperature distribution in the isothermal transportation container is controlled by thermal conduction, resulting in that the temperature distribution in the isothermal transportation container is made uniform. Further, the thermal transfer from the thermal storage medium in the transport container is promoted, so that the heat storage amount possessed by the thermal storage medium can effectively be utilized. Therefore, the temperature of the transported article can be kept to be almost constant over a long period.

DETAILED DESCRIPTION OF THE REFERRED EMBODIMENTS

Figure 1:
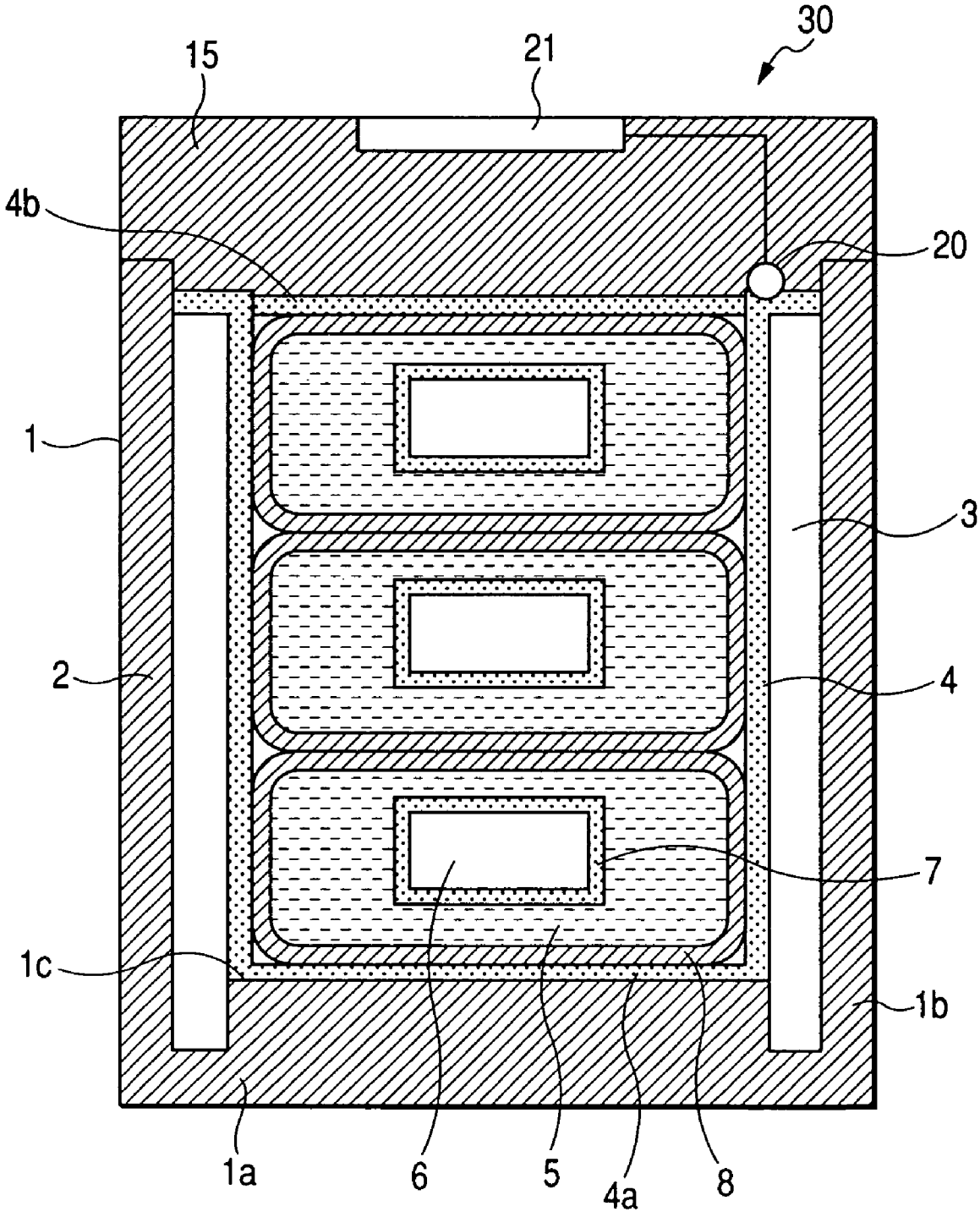
FIG. 1 is a longitudinal sectional view showing an isothermal transportation container according to one embodiment of the present invention.
Figure 2:
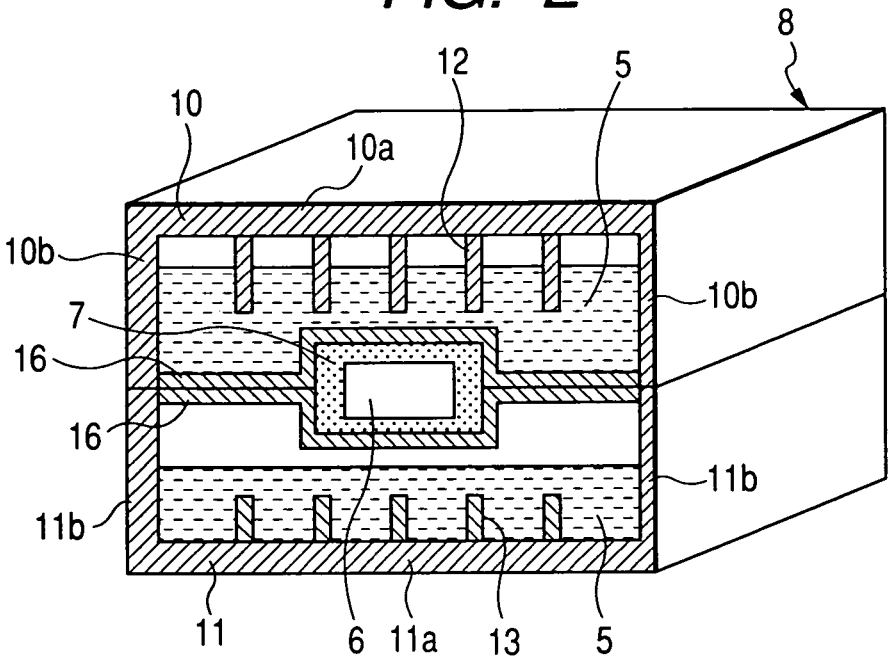
FIG. 2 is a perspective view showing a partial section of a packaging container accommodated in the isothermal transportation container shown in FIG. 1.
Figure 3:
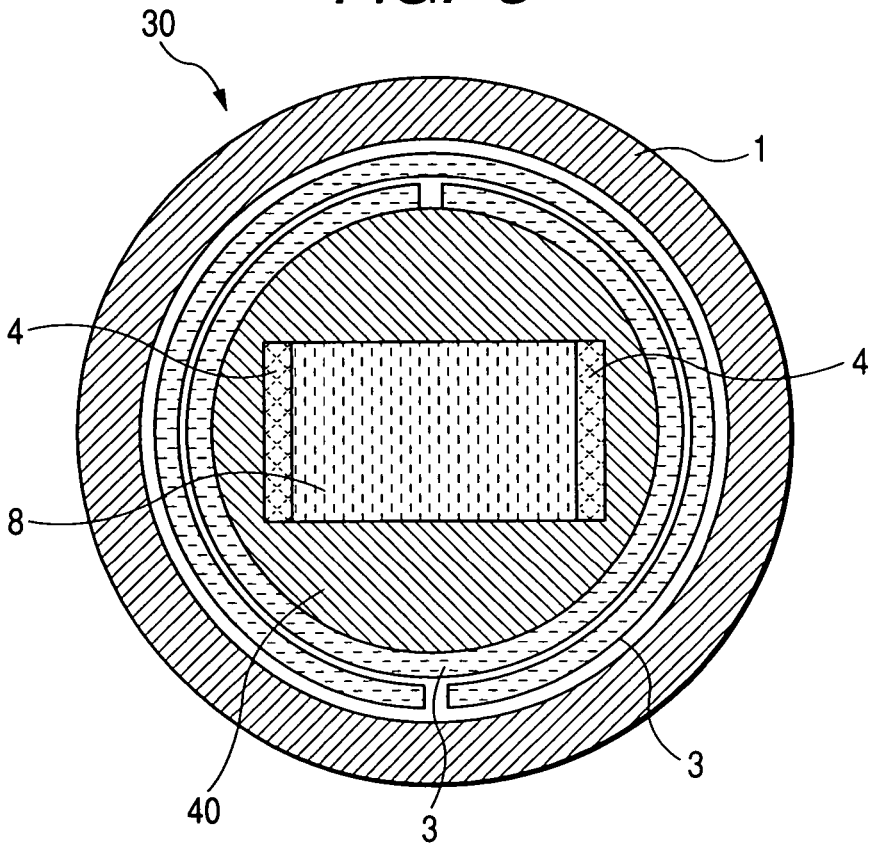
FIG. 3 is a cross-sectional view showing the isothermal transportation container shown in FIG. 1.

An embodiment of an isothermal transportation container according to the present invention will be explained hereinafter with reference to FIGS. 1 to 4. FIG. 1 shows a longitudinal sectional view of an isothermal transportation container 30, FIG. 2 shows a detailed perspective view of a packaging container 8 accommodated in the isothermal transportation container 30, and FIG. 3 is a cross-sectional view of the isothermal transportation container 30. The isothermal transportation container 30 has a cylindrical insulating container 1 and a lid 15 covering the top face of the insulating container 1.

The insulating container 1 is formed from a container 2 having a cylindrical outer shape and made of an insulating material. A double vacuum insulating material 3 is arranged along the inner wall of this container 2. A metallic thermal conductive member 4 made by bending a plate and having satisfactory thermal conductivity is arranged on the inside of the vacuum insulating material 3 extending in the vertical direction. The lower end section of the thermal conductive member 4 is positioned slightly above the lower end section of the vacuum insulating material 3 and forms a bottom face 4*a*. A thermal conductive member 4*b* is attached at the inside face of the lid 15. A temperature sensor 20 for detecting the temperature of the thermal conductive member 4 is mounted to a part of the lid 15 so as to be in contact with the thermal conductive member 4. A temperature display device 21 for displaying the temperature detected by the temperature sensor 20 is mounted to the top face of the lid 15.

As shown in FIG. 3, the thermal conductive member 4 is configured such that two opposite plates communicate with each other at the lower end section. The space formed between two plates of the thermal conductive member 4 is for accommodating plural packaging containers 8, three in FIG. 1. Urethane is filled in the gap, that is formed on the outside of the space for accommodating the packaging container 8 and formed with the vacuum insulating material 3, for serving an insulating function and for holding the thermal conductive member 4. The packaging container 8 has a shape of rectangular solid with rounded corners. It has a size matching the space formed by the thermal conductive member 4. Since the size of the packaging container 8 matches the thermal conductive member 4, the positional deviation of the packaging container 8 in the isothermal transportation container 30 during the transportation can be prevented. A transported article 6 having a shape of rectangular solid and covered with a second thermal conductive member 7 is held in the packaging container 8. A thermal storage medium 5 is filled in the gap between the second thermal conductive member 7 and the packaging container 8. A subject to be transported is composed of a plurality of transported articles 6.

The vacuum insulating material 3 is formed in such a manner that the surrounding of a fibrous core member used for keeping the shape is sealed with a thin-plate or film and its inside is evacuated. Examples of the core member include a metallic thin wire or glass wool fiber, and examples of the film member include a thin-plate or film made of aluminum or stainless. The thermal conductive member 4 is, for example, a copper plate. The packaging container 8 is made of a transparent resin in order that the state on the inside can be grasped. The vacuum insulating member 3 is formed into a mat and wound around the inner periphery of the insulating container 1, resulting in that a small gap is formed on the edge section in the peripheral direction of the vacuum insulating member 3. In order to cover the edge section, another vacuum insulating member 3 is wound around the inside thereof. In this case, the position of the edge section in the peripheral direction of the inner vacuum insulating member 3 is differed from the position of the edge section of the outer vacuum insulating member 3.

FIG. 2 shows in detail that the transported article 6 is held in the packaging container 8. The packaging container 8 has a lid section 10 and a box section 11 each having generally the same shape. Plural upper ribs 12 are formed on the inside of the top plate 10*a* of the lid 10, while plural lower ribs 13 are formed on the inside of the bottom plate 11*a* of the box section 11. The upper ribs 12 and the lower ribs 13 are formed so as to be parallel to the side walls 10*b* and 11*b* respectively. The mating face of the lid section 10 with the box section 11 and the mating face of the box section 11 with the lid section 10 are covered with a flexible film 16. The thermal storage medium 5 is filled in the space formed by the film 16. A latent thermal storage medium performing liquid-solid phase change at a constant temperature, such as sodium phosphate, paraffin, water, or the like, is desirably used for the thermal storage medium 5.

A space for holding the transported article 6 is formed in the vicinity of the center of the films 16. The transported article is held in this space covered by the second thermal conductive member 7 having satisfactory thermal conductivity. A film-like or thin plate-like copper is used for the second thermal conductive member 7, for example.

The action and operation of the isothermal transportation container 30 thus configured in this embodiment will be explained hereinafter. The amount of heat input from the bottom 1*a* of the insulating container 1 is greater than the amount of heat input from the side face 1*b*. Since the thermal conductive member 4 is sufficiently high even if the temperature at the bottom 1*a* rises, the heat inputted from the bottom 1*a* is not transmitted only partially but is transmitted on the whole of the inside of the insulating container 1 by the thermal conductive member 4. Further, the non-uniformity in the temperature distribution can be restrained. Accordingly, the thermal storage medium 5 uniformly absorbs heat, whereby the variation in the amount of heat absorption of the thermal storage medium 5 can be restrained in all packaging containers 8 accommodated in the insulating container 1.

Even if the remaining heat storage amount accumulated by the thermal storage medium 5 is different from each packaging container 8 and the heat storage amount possessed by the thermal storage medium 5 of the packaging container 8 at the side of the bottom 1*a* of the insulating container 1 is lost at an early stage, the heat storage amount of the thermal storage medium 5 arranged in the other packaging containers 8 can be transmitted by a heat transmission, whereby the temperature rise of the thermal conductive member 4 can be restrained. Thus, the temperature rise in the transported article 6 arranged on the side of the bottom 1*a* of the insulating container 1 can be prevented.

The thermal storage medium 5 and the transported article 6 are held in the packaging container 8, wherein the thermal storage medium 5 is arranged around the transported article 6. Therefore, even if the heat is inputted from the outside of the packaging container 8, the temperature of the transported article 6 does not rise unless the temperature of the thermal storage medium 5 rises. Since the thermal storage medium 5 is provided, the temperature of the transported article 6 can be maintained within a predetermined range over a long period. The heat of the respective packaging containers 8 is transmitted to the thermal conductive member 4, which means the thermal conductive member 4 makes the temperature of each packaging container 8 uniform. Accordingly, the problem can be avoided, such as the amount of heat input to the thermal storage medium 5 is clustered depending upon a place, or a part of the thermal storage medium 5 is melted and left. The amount of heat of the thermal storage medium 5 can effectively be utilized. This embodiment describes the case of keeping the transported article 6 cool by the insulating container 1. However, the same effects can be obtained in the case where the transported article 6 is kept warm by the insulating container 1.

The transported article 6 is covered with the second thermal conductive member 7. Therefore, even if only the thermal storage medium 5 arranged below the transported article 6 loses the heat storage amount, the temperature rise of the transported article 6 can be restrained by utilizing the heat storage amount left above the transported article 6 or at the side of the transported article 6. It should be noted that the amount of the thermal storage medium 5 accommodated in the packaging container 8 may be constant considering productivity or may be variable depending upon each transported article 6. In the case where the amount of the thermal storage medium 5 is constant, the amount is set under the condition where the required heat storage amount is the maximum. The isothermal transportation container can easily cope with the change in the transportation time for the transported article 6 by preparing the packaging container 8 having the thermal storage medium 5 whose holding amount is varied. When just a small amount of the thermal storage medium 5 is enough, the time for accumulating heat in the thermal storage medium 5 can be shortened, and further, the amount of heat can be restrained. The isothermal transportation container can also cope with the same situation by changing the type of the thermal storage medium 5.

When the amount of the thermal storage medium 5 is changed as for a certain packaging container 8, the remaining heat storage amount varies. However, the heat accumulation of the thermal storage medium 5 in the other packaging container 8 is transmitted to the inside of the insulation container 1 via the thermal conductive member 4. Accordingly, the temperature in the insulating container 1 can be made uniform over a long period.

Since the space for accommodating the thermal storage medium 5 is formed in the packaging container 8 and the transported article 6 is held between the mating faces of the films 16, the thermal storage medium 5 can easily and surely be arranged around the transported article 6. This prevents the problem of the temperature of the transported article 6 being partially deviating from the appropriate range due to the maldistribution of the thermal storage medium 5. The upper ribs 12 and lower ribs 13 formed on the lid section 10 and the box section 11 direct toward the thermal storage medium 5, so that the contact area between the thermal storage medium 5 and the packaging container 8 increases. The heat exchange between the thermal storage medium 5 and the packaging container 8 is promoted, whereby uniformalizing the temperature of the packaging container 8 is promoted. Since the packaging container 8 is formed from a transparent resin, the melted state of the thermal storage medium 5 can visually and easily be confirmed. Accordingly, the state of the heat storage can visually be grasped during the transportation of the packaging container 8, thereby preventing the packaging container 8 that has not yet stored sufficient heat from being erroneously used.

When the thermal storage medium 5 becomes the state of the heat storage and thereby becomes the state of liquid, the thermal storage medium 5 of the state of liquid tends to be accumulated at the lower portion. In this case, the distance between the thermal storage medium 5 and the top plate 10*a* and the distance between the thermal storage medium 5 and the bottom plate 11*a* is different from each other. In view of this, the upper ribs 12 are made longer than the lower ribs 13. According to this, the upper ribs 12 and the lower ribs 13 surely reach the inside of the thermal storage medium 5. When the end face of each of the upper ribs 12 and the end face of each of the lower ribs 13 are brought into contact with the film 16, the temperature of the transported article 6 rises via each rib 12, 13 before the temperature of the thermal storage medium 5 rises. Therefore, the embodiment takes a configuration in which each of the ribs 12 and 13 are coupled only to the top plate 10*a* or bottom plate 11*a* of the packaging container 8.

In this embodiment, the bent thermal conductive member 4 is arranged on the holding section 40 of the packaging container 8 formed from urethane. Therefore, the packaging container 8 can be taken out from the insulating container 1 only by lifting the upper edge of the thermal conductive member 4. Accordingly, even if plural packaging containers 8 are laminated, the transported article 6 can easily be taken out, thereby enhancing workability. In order to achieve a simple configuration, the outer surface of the packaging container 8 may be covered by a metal having satisfactory thermal conductivity, such as a copper, for serving also as the thermal conductive member 4, whereby the non-uniform temperature distribution in the insulating container 1 may be restrained.

The vacuum insulating material 3 is excellent in heat insulating property in the direction perpendicular to a plane. However, heat is easy to escape from the edge section since the outer surface of the vacuum insulating material 3 is covered by a metal. The edge sections of the same vacuum insulating material 3 are made close to each other as much as possible in the peripheral direction, and the vacuum insulating material 3 is doubled in order that the edge sections of the inner vacuum insulating material and the outer vacuum insulating material do not agree with each other in the peripheral direction. This structure can control the amount of heat entering from the edge sections in the peripheral direction. The lower edge section of the vacuum insulating material 3 is made lower than the inner bottom face 1*c* of the insulating container 1 to restrain the heat going around and entering from the lower edge section, whereby the heat insulating property of the insulating container 1 is enhanced.

Since the temperature display device 21 is provided on the lid 15, it can be confirmed whether the inside temperature is kept to be a predetermined temperature range without opening the lid 15. The temperature sensor 20 is provided on the inside of the lid 15 and the temperature display device 21 is provided on its surface. Therefore, the wiring connecting both components is not exposed to the outside, whereby easy-to-handle structure is achieved. The temperature of the transported article 6 deviates from the predetermined range after the temperature of the temperature sensor 20 deviates from the predetermined range. Therefore, if the temperature of the temperature sensor 20 is within the predetermined range, there is no chance that the temperature of the transported article 6 is out of the predetermined range. In this embodiment, the temperature of the thermal conductive member 4 is adopted as a representative temperature in the insulating container 1, resulting in that the insulating container 1 can always be managed in a safety condition.

Figure 4:
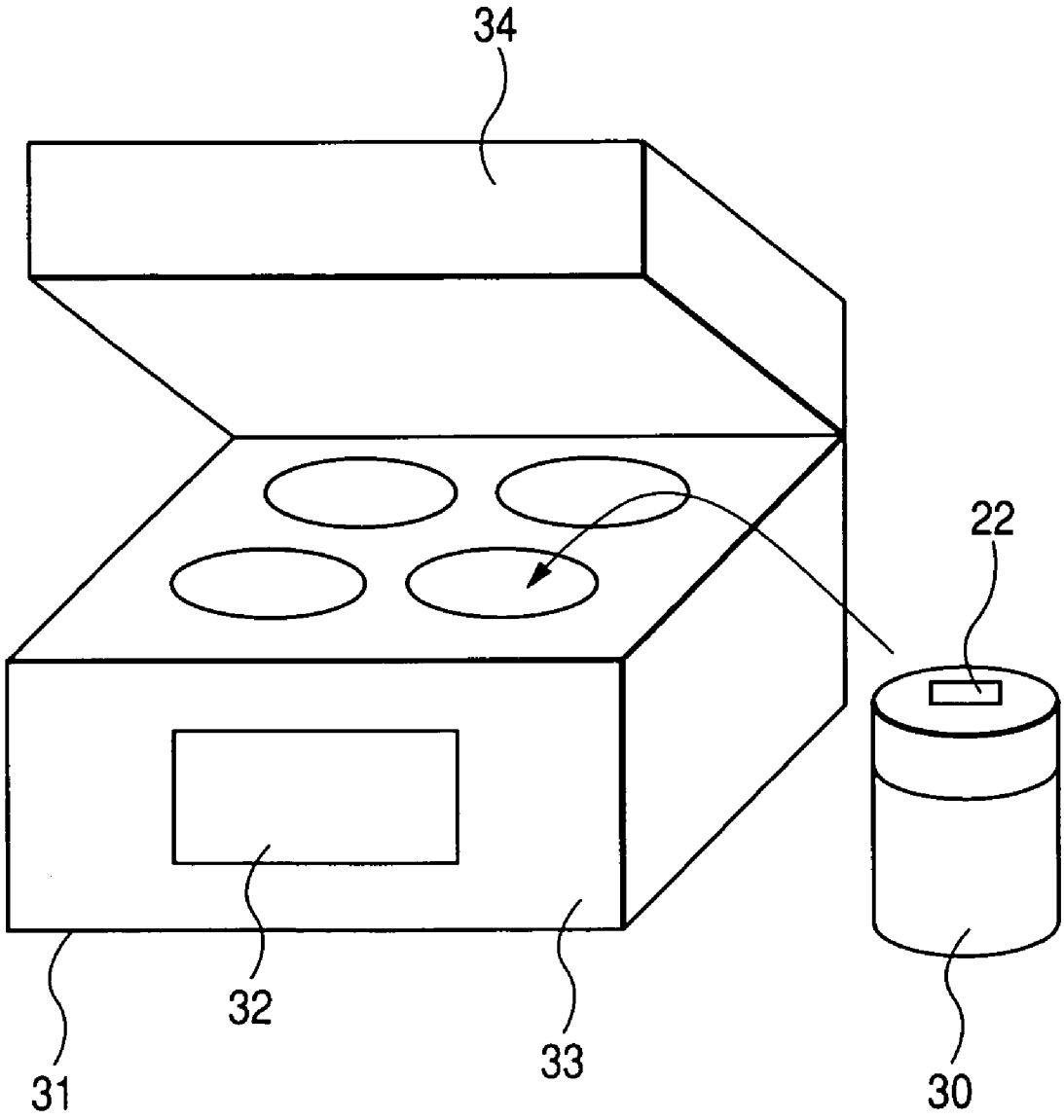
FIG. 4 is a perspective view showing a carrier container that accommodates the isothermal transportation container shown in FIG. 1.

FIG. 4 shows a state in which plural isothermal transportation containers 30 shown in FIG. 1 are accommodated in a carrier container 31 to be transported. In FIG. 4, plural packaging containers 8 having the transported article 6 accommodated therein are stored in each isothermal transportation container 30. The carrier container 30 is an openable/closable box-like vessel having a main body 33 to which plural holes having the height same as that of the isothermal transportation container 30 are formed, and a lid 34 that covers the top face of the accommodated isothermal transportation container 30. It is provided with a temperature display section 32 that can display en bloc the temperatures detected by each of the temperature sensor 20 at the respective isothermal transportation containers 30 accommodated therein, at the front side face.

According to this embodiment, the temperature in the respective isothermal transportation containers can be grasped without opening the lid 34 of the carrier container 31. This carrier container 31 functions as an insulating material around the carrier container 31. Therefore, the reduced number of opening times of the lid 34 is advantageous in keeping the heat insulating property, whereby the temperature of the transported article 6 can be maintained to a predetermined temperature over a long period. The temperature detected by the temperature sensor 20 at each isothermal transportation container 30 is displayed on the temperature display section 32 at the carrier container 31 by switching the contact of a change-over device not shown. The temperature display section 32 can of course be configured to display plural temperatures.

The temperature display device 21 and the temperature display section 32 have an alarm telling a transporter that the temperature detected by each temperature sensor 20 has deviated from the predetermined range. The transporter can confirm the need for exchanging the thermal storage medium 5 or the sealed state of the carrier container 31, isothermal transportation container 30 and packaging container 8, resulting in that he/she can quickly take a necessary measure, thereby being capable of avoiding the extraordinary temperature rise or temperature fall of the transported article.

Means for predicting the temperature of the transported article 6 may be provided on the temperature display device 21 or temperature display section 32. The predicting means predicts the future temperature change from the value detected by the temperature sensor 20 and its rate of change with time. When the predicted temperature deviates from the predetermined range, it tells this state to a transporter in advance. A device applied to an electronic thermometer can be used for the predicting means, for example. Utilizing an electronic thermometer facilitates the installation with reduced cost. The transporter can take a suitable action, such as improving the environmental condition around the carrier container 31 or contacting the party from which the article is transported or the party to which the article is transported. This structure can prevent the damage due to the temperature change of the transported article 6 to a minimum. Further, a function for telling the result of the prediction of the temperature to the party from which the article is transported or the party to which the article is transported may be added to the temperature display device 21 or temperature display section 32. The temperature display device 21 or temperature display section 32 may store the record of the temperature change of the transported article 6.

Figure 5:
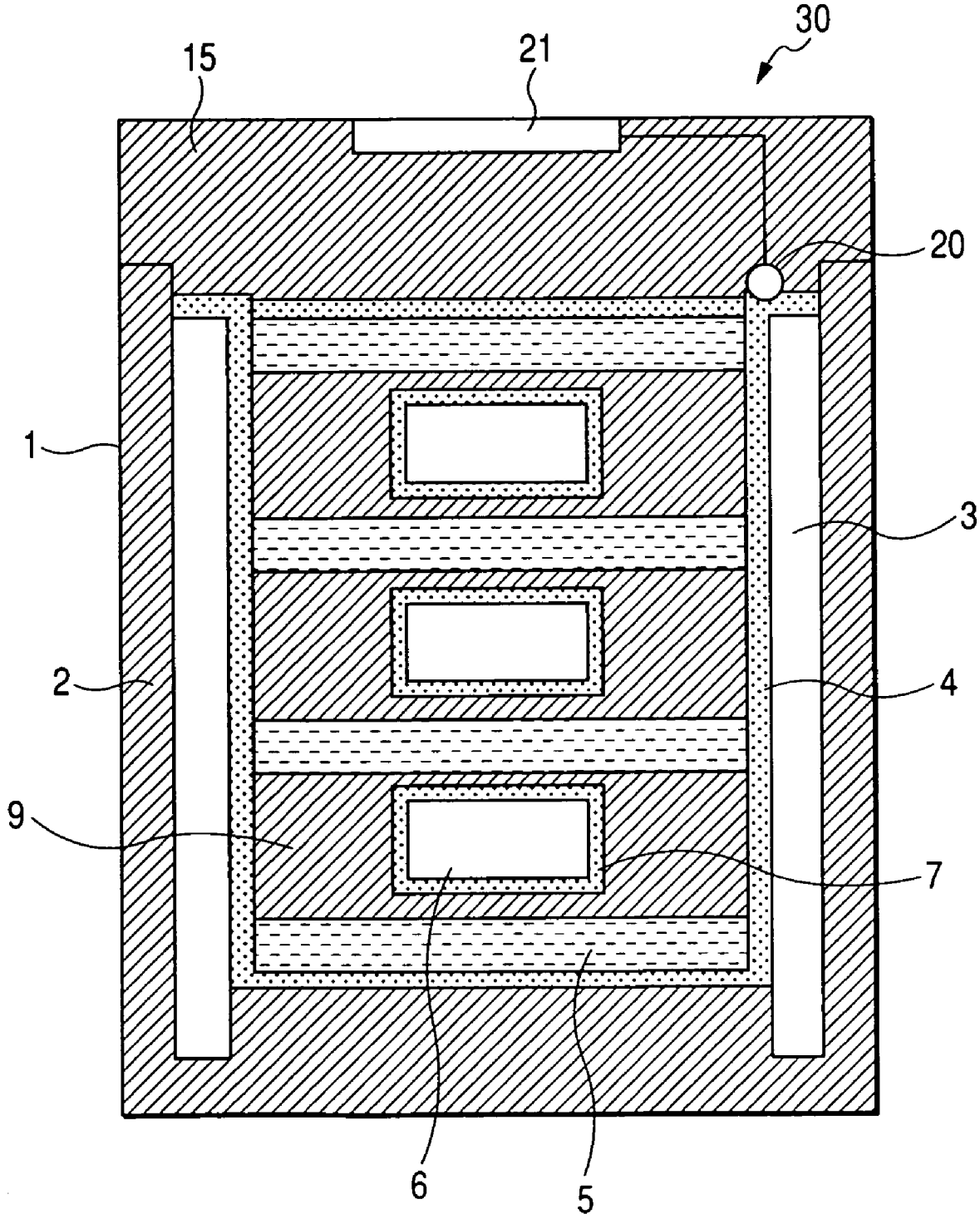
FIG. 5 is a longitudinal sectional view showing an isothermal transportation container according to another embodiment of the present invention.

FIG. 5 is a longitudinal sectional view showing an isothermal transportation container 30 according to another embodiment of the present invention. The isothermal transportation container 30 in this embodiment is different from that in the embodiment 1 in that, instead of using the packaging container 8, the transported article 6 is covered with an insulating material 9, and a thermal storage medium 5 is inserted in the space of the insulating material 9 in the vertical direction upon laminating the transported articles 6 covered with the insulating material 9. The thermal storage medium 5 is also arranged below the lower most insulating material 9 and above the uppermost insulating material 9. The aforesaid vacuum insulating material or commercial insulating material may be used for the insulating material 9.

This embodiment does not use the exclusive packaging container 8, thereby easy to be manufactured. The thermal storage medium 5 can be formed into a plate-like shape. Therefore, in the case where the thermal storage medium 5 is used after being coagulated or melted in advance, a small capacity is enough, whereby great heated area or cooled area can be secured. Accordingly, the time taken for the coagulation or melting can be shortened. In the case where the number of the transported articles 6 is few, the insulating material 9 or thermal storage medium 5 can easily be filled in the space in the isothermal transportation container 30. When the thermal storage medium 5 is filled therein, the heat storage amount increases, so that the heat insulating property of the transported article 6 can easily be increased. The isothermal transportation container 30 in this embodiment is suitable for the tough condition in the open-air temperature or suitable for the situation of long transporting time. In this case, more thermal storage mediums 5 are arranged on the upper section. Even if the heat storage amount varies, the uniformity in the temperature is achieved by the thermal conductive member 4, so that the heat storage effect can be given for a long period. The transportable time can surely be prolonged, and further, it is unnecessary to put in excessive thermal storage medium 5. Although the thermal storage medium 5 and the transported article 6 are alternately laminated in this embodiment, it is not limited thereto. For example, a single layer of the thermal storage medium 5 may be provided and only the transported article 6 may be laminated.

Figure 6:
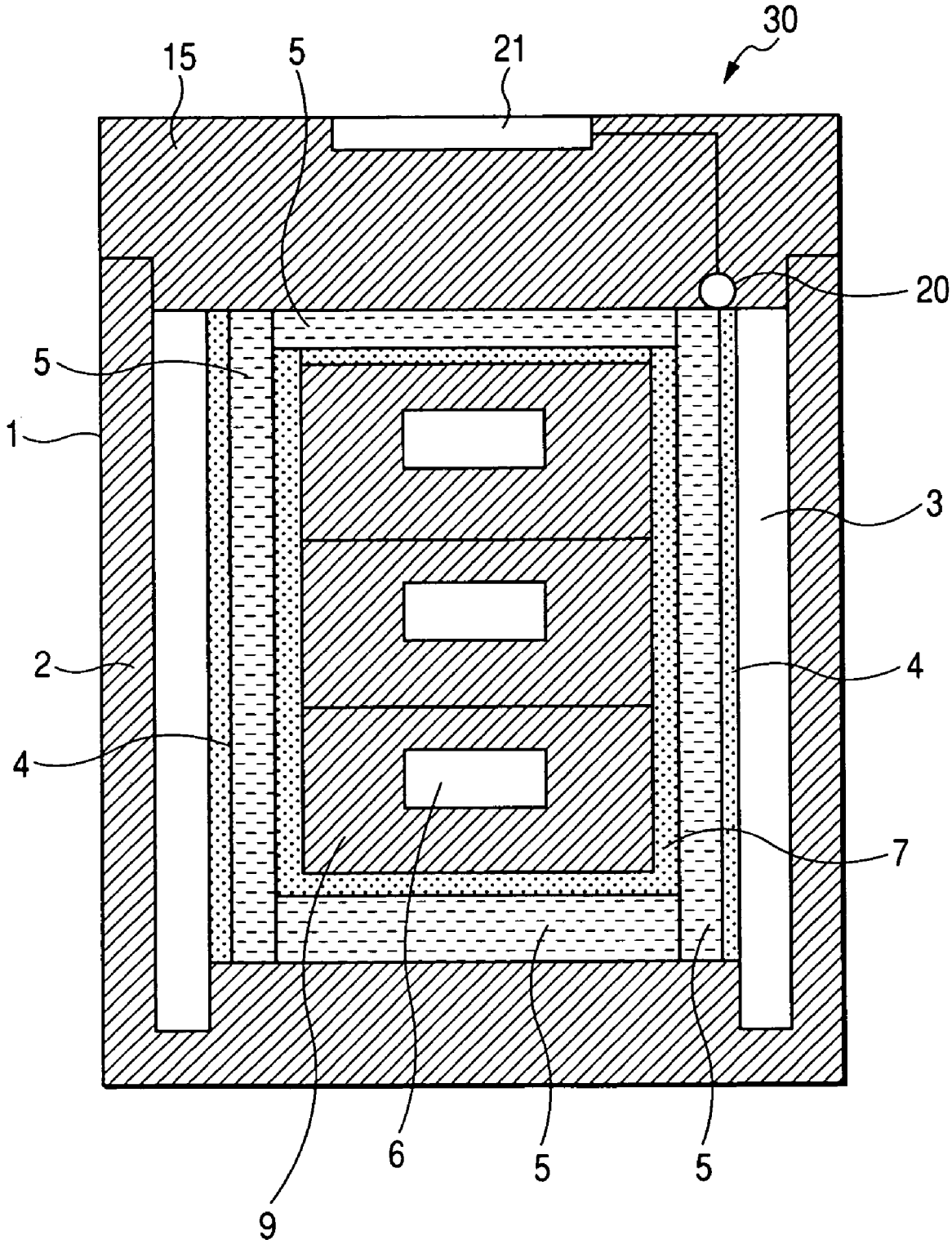
FIG. 6 is a longitudinal sectional view showing an isothermal transportation container according to still another embodiment of the present invention.

FIG. 6 is a longitudinal sectional view of an isothermal transportation container according to still another embodiment of the present invention. In this embodiment, the transported articles 6 covered with the insulating material 9 are laminated, the whole laminated insulating material 9 is covered with the second metallic thermal conductive member 7, and the thermal storage medium 5 is filled around the outer periphery of the second thermal conductive member 7. Plural thermal storage mediums 5 sealed in the plate-like container are arranged in the insulating container 1, whereby the volume of the single thermal storage medium 5 can be reduced. Further, the second thermal conductive member 7 is also arranged on the inner side of the thermal storage medium 5 and the insulating material 9 is arranged on the inside thereof. Therefore, even if the temperature in a part of the thermal storage medium 5 lowers from the predetermined temperature, the amount of heat possessed by the other thermal storage medium 5 can be transmitted through the second thermal conductive member 7, with the result that a local temperature fall at the inside of the second thermal conductive member 7 can be avoided.

Although each of the four faces of the transported article 6 is covered with the thermal conductive member 4 in the embodiments shown in FIGS. 1 to 5, the thermal conductive member 4 may partially be provided as in this embodiment. The amount of the thermal conductive member 4 is reduced in this embodiment, and therefore the weight of the isothermal transportation container 30 is reduced.

What is claimed is:

1. An isothermal transportation container comprising an insulating container and a lid that can seal the insulating container, wherein the insulating container has a plurality of insulating materials arranged overlapped on the inner peripheral face thereof, wherein a thermal conductive member is arranged in a space in the insulating container formed by the insulating materials, wherein the thermal conductive member can accommodate a plurality of laminated packaging containers, each of which accommodates a thermal storage medium and a transported article, and is arranged so as to be thermally in contact with the packaging containers, wherein the heat in the thermal storage medium in one packaging container can be transmitted to the other container through the thermal conductive member.

2. An isothermal transportation container according to claim 1, wherein the upper end section of the thermal conductive member is formed into a bent shape, wherein a user can take out the packaging containers by using the bent shape.

3. An isothermal transportation container comprising an insulating container and a lid that can seal the insulating container, wherein the insulating container has a plurality of insulating materials arranged overlapped on the inner peripheral face thereof, wherein a thermal conductive member is arranged in a space in the insulating container formed by the insulating materials, wherein the thermal conductive member can accommodate a container, that has an insulating material for accommodating a transported article therein, and thermal storage medium as alternately laminated, and is arranged so as to be thermally in contact with the container and the thermal storage medium, wherein the heat in the thermal storage medium can be transmitted to the container through the thermal conductive member.

4. An isothermal transportation container according to any one of claims 1 to 3, wherein the outer surface of the transported article is covered with a second thermal conductive member.

5. A packaging container used for an isothermal transportation container having an insulating container and a lid that can seal the insulating container and accommodating a thermal storage medium therein, comprising a lid section that can be opened and closed, a box section that forms a sealing container with the lid section, flexible films accommodating the thermal storage medium in the space formed by the lid section and the box section and formed on the mating face between the lid section and the box section for closing the respective spaces, wherein a space in which a transported article can be stored is formed on the center of each film, and a plurality of ribs are formed in the space formed by the lid section and the box section.

6. A packaging container according to claim 5, wherein the outer surface is covered with a thermal conductive member.

7. A packaging container according to claim 5 or claim 6, wherein the ribs are provided so as to project inwardly from the outer wall face of the thermal storage medium accommodating section.

8. A packaging container according to claim 6, wherein the height of each rib formed on the lid section is made higher than the height of each rib formed on the box section.

9. A packaging container according to claim 5, wherein the thermal storage medium is sealed in a container made at least partially of a transparent material.

10. An isothermal transportation container comprising an insulating container and a lid that can seal the insulating container, wherein the insulating container has a plurality of insulating materials arranged overlapped on the inner peripheral face thereof, wherein a thermal conductive member is arranged in a space in the insulating container formed by the insulating materials, and a thermal storage medium is arranged on the side of the inner face of the thermal conductive member, wherein the thermal storage medium can accommodate a subject to be transported that has a plurality of laminated packaging containers, each of which accommodates a transported article therein, and is covered with a second thermal conductive member.

11. An isothermal transportation container according to any one of claims 1, 3 and 10, wherein the inner shape of the insulating container is cylindrical, and the insulating material is composed of a plurality of mat-like vacuum insulating materials, wherein the vacuum insulating materials are laminated along the cylindrical face and the edge sections of the vacuum insulating materials are varied in the laminate direction.

12. An isothermal transportation container according to claim 11, wherein the end face at the lower side of the vacuum insulating material is lower than the inner bottom face of the insulating container.

13. An isothermal transportation container according to any one of claims 1, 3 and 10, wherein a temperature sensor is provided on the back face of the lid, and a display section for displaying the temperature detected by the temperature sensor is provided on the surface of the lid.

14. An isothermal transportation container according to claim 13, wherein the temperature sensor comes in contact with the thermal conductive member.

15. A carrier container for an isothermal transportation container that is an insulating container which can accommodate a plurality of isothermal transportation containers according to claim 1 or claim 3, and that is provided with temperature display means for displaying the temperature detected by the temperature sensor at each isothermal transportation container.

16. A carrier container for an isothermal transportation container according to claim 15, comprising means for giving an alarm in the case where the temperature in the isothermal transportation container deviates from a predetermined range.

* * * * *